US006454433B1

(12) United States Patent
Alessio

(10) Patent No.: US 6,454,433 B1
(45) Date of Patent: Sep. 24, 2002

(54) DUAL FACETED REFLECTOR

(75) Inventor: David J. Alessio, Amherst, OH (US)

(73) Assignee: Eveready Battery Company, Inc., St. Louis, MI (US)

( * ) Notice: Subject to any disclaimer, the term of this patent is extended or adjusted under 35 U.S.C. 154(b) by 0 days.

(21) Appl. No.: 09/864,557

(22) Filed: May 24, 2001

(51) Int. Cl.[7] ..... F21L 4/00

(52) U.S. Cl. ..... 362/157; 362/202; 362/208; 362/297; 362/346; 362/347; 362/348; 362/350; 362/304; 362/518

(58) Field of Search ..... 362/157, 202, 362/208, 347, 348, 350, 346, 297, 304, 578

(56) References Cited

U.S. PATENT DOCUMENTS

| | | | | |
|---|---|---|---|---|
| 4,021,659 | A | | 5/1977 | Wiley |
| 4,153,929 | A | | 5/1979 | Laudenschlarger et al. |
| 4,241,389 | A | | 12/1980 | Heimer |
| 4,277,821 | A | | 7/1981 | Sassmannshausen |
| 4,327,972 | A | | 5/1982 | Brunsting |
| 4,393,439 | A | | 7/1983 | James, Jr. |
| 4,605,994 | A | | 8/1986 | Kreig |
| 4,635,170 | A | | 1/1987 | Beiswenger |
| 4,706,173 | A | | 11/1987 | Hamada et al. |
| 4,783,725 | A | | 11/1988 | Schaller et al. |
| 4,885,668 | A | | 12/1989 | Maglica et al. |
| 4,920,469 | A | | 4/1990 | Harding |
| 4,984,140 | A | | 1/1991 | Ellion |
| 5,001,612 | A | | 3/1991 | Odlum |
| 5,045,980 | A | | 9/1991 | Harvey |
| 5,072,346 | A | | 12/1991 | Harding |
| 5,103,381 | A | | 4/1992 | Uke |
| 5,192,126 | A | | 3/1993 | Remeyer et al. |
| 5,440,463 | A | | 8/1995 | Ellion |
| 5,459,649 | A | | 10/1995 | Ellion |
| 5,661,828 | A | | 8/1997 | Riser et al. |
| 5,678,921 | A | | 10/1997 | Kish et al. |
| 5,682,448 | A | | 10/1997 | Riser et al. |
| 5,806,962 | A | | 9/1998 | Ellion |
| 5,871,272 | A | | 2/1999 | Sharrah et al. |
| 5,934,779 | A | | 8/1999 | Leidig |
| 5,957,567 | A | * | 9/1999 | Kish et al. ..... 362/202 |
| 6,161,946 | A | | 12/2000 | Bishop et al. |
| 6,206,549 | B1 | | 3/2001 | Li |
| 6,296,382 | B1 | * | 10/2001 | Hamelbeck ..... 362/235 |

FOREIGN PATENT DOCUMENTS

| | | | | |
|---|---|---|---|---|
| AU | 2053595 | | 12/1995 | |
| CH | 689311 | A5 | 2/1999 | |
| DE | 3523005 | A1 | 1/1987 | |
| DE | 3700198 | A1 | 8/1988 | |
| DE | 4110985 | A1 | 10/1992 | |
| DE | 29615389 | | 12/1996 | |
| DE | 29917634 | | 1/2000 | |
| EP | WO 92/17733 | | * 10/1992 | ..... F21V/7/09 |
| EP | 0560327 | A2 | 3/1993 | |
| EP | 0560327 | A3 | 3/1993 | |
| EP | 0629816 | A1 | 4/1994 | |
| EP | 0560327 | B1 | 2/1996 | |
| FR | 2543695 | | 3/1984 | |
| GB | 2184824 | | 7/1987 | |
| GB | 2247069 | | 2/1992 | |
| JP | 9231808 | | 9/1997 | |
| JP | 9231809 | | 9/1997 | |
| JP | 9231812 | | 9/1997 | |
| JP | 9231813 | | 9/1997 | |
| SE | 8404756 | | 3/1986 | |
| WO | 9215484 | | 9/1992 | |
| WO | 9423243 | | 10/1994 | |

* cited by examiner

*Primary Examiner*—Stephen Husar
*Assistant Examiner*—Bertrand Zeade
(74) *Attorney, Agent, or Firm*—Robert W. Welsh

(57) ABSTRACT

A reflector comprising a concave body having a first region, a second region and a third region. The first region includes first facets and the second region includes second facets. The third region has a smooth surface. The first region is separated from the second region by the third region.

22 Claims, 2 Drawing Sheets

DUAL FACETED REFLECTOR

BACKGROUND OF THE INVENTION

The present invention relates to lighting devices and, more particularly, to a reflector used in a flashlight.

Lighting devices are used extensively as flashlights for lighting dark areas and as signaling lamps, for safety, etc.

Heretofore, flashlights have typically included a cylindrical housing with a closed end and an opposite open threaded end. Batteries are inserted into the cylindrical housing and a lamp holder including a light source and a reflector is threaded over the open threaded end of the housing. A switch, usually located on the outer circumference of the housing, can then be activated to alternatively turn the flashlight on and off. The lamp holder typically includes a spring that is biased against the batteries in the housing as the lamp holder is screwed onto the housing. The spring also serves as an electrical contact for powering a lamp in the lamp holder. Typically, the reflector has a parabolic shape for directing the light from the light source to a relatively small area to illuminate the small area. The reflectors have included smooth surfaces for redirecting the light from the light source. However, only the central portion of the reflecting surface of a smooth surfaced reflector has served to produce the light beam to form a uniform beam of light, with outer portions of the reflector producing trail light in random directions. The light from the outer portions is undesirable because it can blur unevenly around the bright spot produced from the light reflected from the central portion of the reflector.

Accordingly, an apparatus solving the aforementioned disadvantages and having the aforementioned advantages is desired.

SUMMARY OF THE INVENTION

One aspect of the present invention is to provide a reflector comprising a concave body having a first region, a second region and a third region. The first region includes first facets and the second region includes second facets. The third region has a smooth surface. The first region is separated from the second region by the third region.

Another aspect of the present invention is to provide a flashlight comprising a battery housing and a bezel connected to the battery housing. The bezel includes a light source configured to be electrically connected to batteries in the battery housing, a reflector and a covering for the light source. The covering is configured to allow light rays coming from the light source and the reflector to pass therethrough. The reflector includes a concave body having a first region, a second region and a third region. The first region includes first facets, the second region includes second facets and the third region has a smooth surface. The first region is separated from the second region by the third region.

Yet another aspect of the present invention is to provide a light reflector comprising a concave body including an outer rim defining a periphery of the body and a light source located within a concave area defined by the body. The light source is configured to emit light rays. The body has a first faceted region, a second faceted region and a smooth region. The smooth region is configured to reflect light rays coming from the light source into a first substantially conical beam of reflected light. The first faceted region is configured to reflect light rays coming from the light source into a second substantially conical beam of reflected light. The second faceted region is configured to reflect light rays coming from the light source into a third substantially conical beam of reflected light. The first substantially conical beam of reflected light, the second substantially conical beam of reflected light and the third substantially conical beam of reflected light have a line of propagation through an axis of each of the first substantially conical beam of reflected light, the second substantially conical beam of reflected light and the third substantially conical beam of reflected light, respectively. A first diameter of a first circle defined by a plane through the first substantially conical beam perpendicular to the line of propagation is smaller than a second diameter of a second circle defined by the plane through the second substantially conical beam at any point along the line of propagation. Furthermore, the second diameter of the second circle defined by the plane through the second substantially conical beam perpendicular to the line of propagation is smaller than a third diameter of a third circle defined by the plane through the third substantially conical beam at any point along the line of propagation.

Accordingly, the reflector can emit light rays to enhance the appearance and overall quality of any product being lit by the light rays coming from the reflector. The reflector is efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
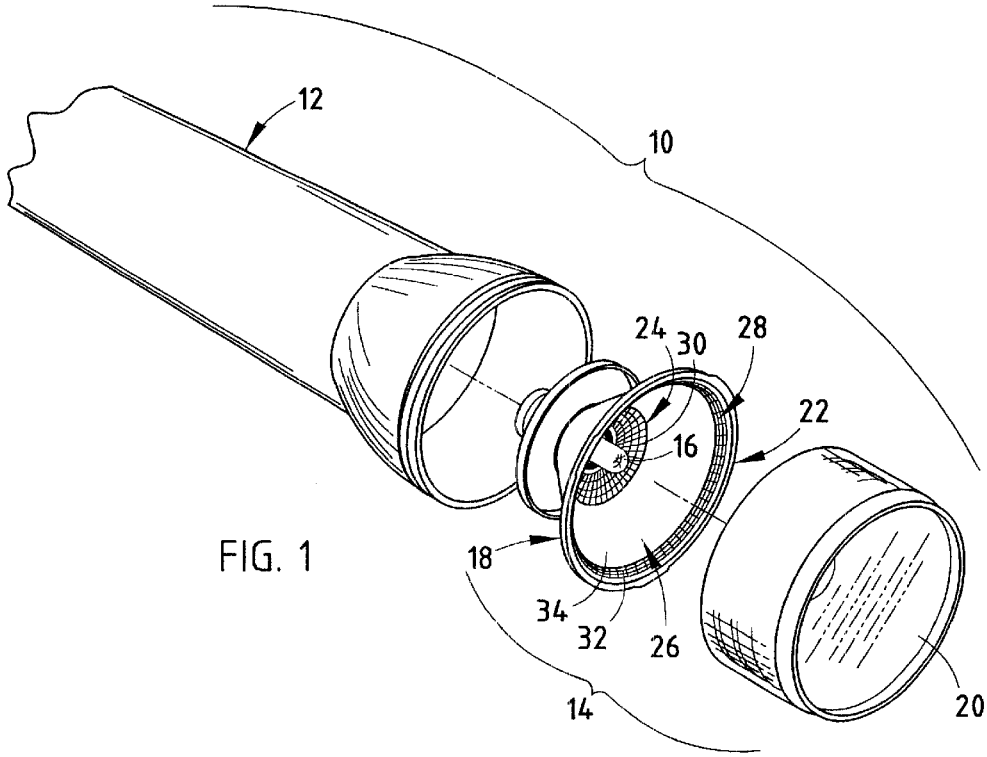
FIG. 1 is an exploded perspective view of a flashlight embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a flashlight having a reflector embodying the present invention. In the illustrated example, the flashlight 10 comprises a battery housing 12 and a bezel 14 connected to the battery housing 12. The bezel 14 includes a light source 16 configured to be electrically connected to batteries in the battery housing 12, the reflector 18 and a covering 20 for the light source 16. The covering 20 is configured to allow light rays coming from the light source 16 and the reflector 18 to pass therethrough. The reflector 18 includes a concave body 22 having a first region 24, a second region 28 and a third region 26. The first region 24 includes first facets 30, the second region 28 includes second facets 32 and the third region 26 has a smooth surface 34. The first region 24 is separated from the second region 28 by the third region 26.

Figure 2:
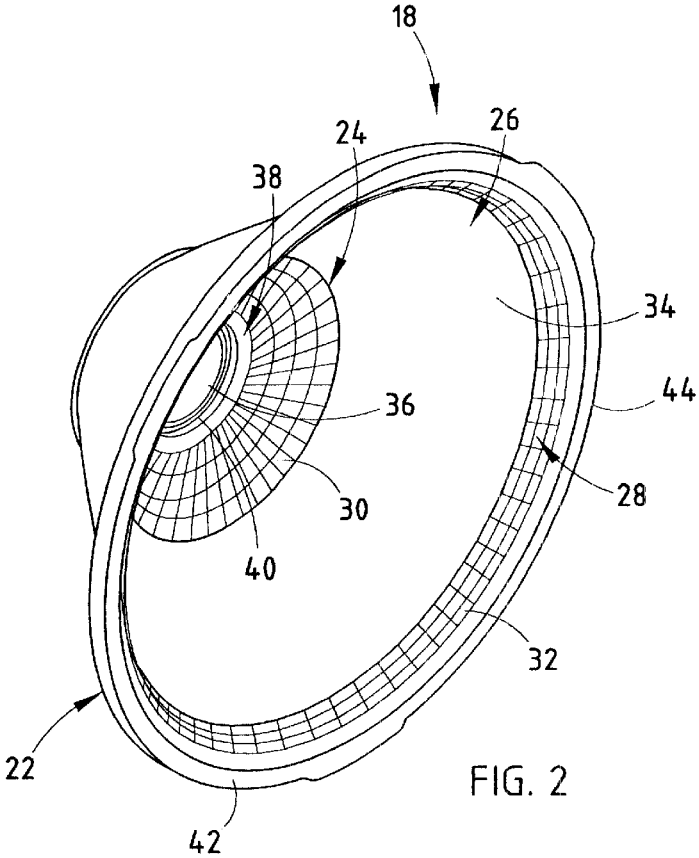
FIG. 2 is a perspective view of a reflector of the present invention.
Figure 3:
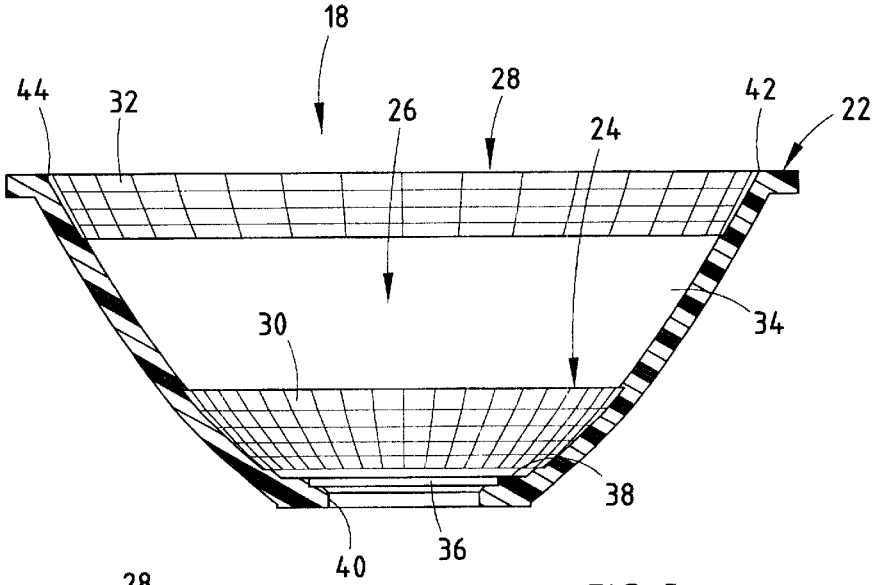
FIG. 3 is a cross-sectional view of the reflector of the present invention.
Figure 4:
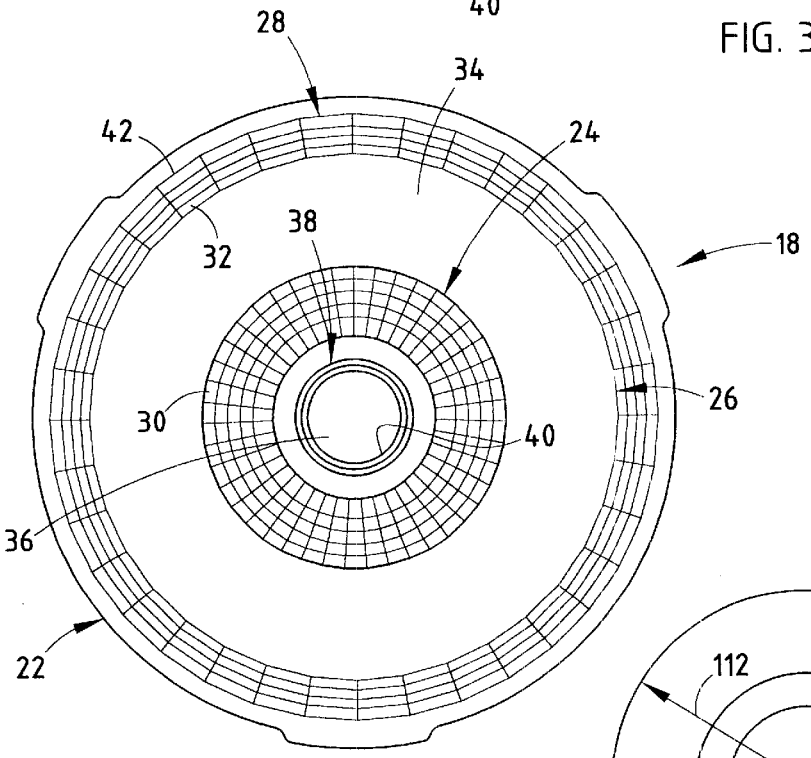
FIG. 4 is a front view of the reflector of the present invention.

In the illustrated example, the concave body 22 of the reflector 18 (FIGS. 2–4) has a closed, substantially parabolic shape, with an opening 36 in a central region 38 for accepting the light source 16 therethrough. The body 22 includes an inner rim 40 defining the opening 36 and an outer rim 42 defining a periphery 44 of the body 22. The first region 24 is adjacent the inner rim 40 and the second region 28 is adjacent the outer rim 42. Therefore, the first facets 30 are separated from the second facets 32 by the smooth surface 34 of the third region 26.

The illustrated reflector 18 includes preferred dimensions for use with a flashlight having two size D batteries. In the preferred embodiment, the reflector has a focal length of 7 mm, a reflector depth of 27.55 mm (before the opening 36 for the light source 16 is placed in the vertex of the central region 38 of the reflector 18) and a reflector radius of 27.75 mm. Assuming that the reflector 18 does not have the opening 36 (for purposes of measurement) and that the reflector 18 is positioned around symmetrically positioned about a z-axis, the first region 24 starts at 5.2 mm and ends at 17.3 mm on the z-axis. Furthermore, the second region 28 starts at 22.4 mm and ends at 27.5 mm on the z-axis. The third region 26 with the smooth surface 34 is located between the first region 24 and the second regions 28. Additionally, the illustrated first region 24 of the reflector 18 preferably has five rows or bands of first facets 30 arranged azimuthally about a first circumferential area of the body 22. Preferably, each row has an equal number of first facets 30, with lines running from the inner rim 40 towards the outer rim 42 defining each first facet 30 in each row. In the preferred embodiment, each row of first facets 30 includes 44 first facets 30. Likewise, the second region 28 of the reflector 38 preferably has four rows or bands of second facets 32 arranged azimuthally about a second circumferential area of the body 22. Preferably, each row has an equal number of second facets 32, with lines running from the outer rim 42 towards the inner rim 40 defining each second facet 32 in each row. In the preferred embodiment, each row of second facets 32 includes 36 second facets 32. In the illustrated example, each first facet 30 and each second facet 32 is trapezoidal shaped. Additionally, the third region 28 is arranged azimuthally about a third circumferential area of the body 22. Moreover, each facet is preferably planar. Although the facets are shown as being trapezoidal, it is contemplated that the facets could have other geometrical configurations including hexagonal. Furthermore, it is contemplated that the facets could be curved instead of planar or that the facets could be staggered instead of in line. Moreover, the smooth surface 34 of the third region 28 is a polished, smooth surface. The reflector 18 could also be used with a flashlight having two size C or two size AA batteries (or any other size) by making the reflector and the faceted portions smaller or larger as the flashlight may require. Further, the reflector could be used on a lantern or on any lighting device.

In the illustrated example, the reflector 18 reflects rays of light from the light source 16 such that a center portion of the reflected beam includes a central region of light of uniform intensity and geometry. The center portion of the reflected beam is composed of a superposition of light reflected from the first region 24, the second region 28 and the third region 26 of the reflector 18. The smooth surface 34 of the third region 26 of the reflector 18 reflects light rays coming from the light source 16 into a first substantially conical beam of reflected light. The first facets 30 of the first region 24 of the reflector 18 reflect light rays coming from the light source 16 into a second substantially conical beam of reflected light. The second facets 32 of the second region 28 reflect light rays coming from the light source into a third substantially conical beam of reflected light. The first substantially conical beam of reflected light, the second substantially conical beam of reflected light and the third substantially conical beam of reflected light have a line of propagation through an axis of each of the first substantially conical beam of reflected light, the second substantially conical beam of reflected light and the third substantially conical beam of reflected light, respectively. The first substantially conical beam of reflected light has a smaller diameter than the second beam of reflected light. The first substantially conical beam of reflected light has a greater intensity than the second beam of reflected light. The second substantially conical beam of reflected light has a smaller diameter than the third beam of reflected light. The second substantially conical beam of reflected light has a greater intensity than the third beam of reflected light.

Figure 5:
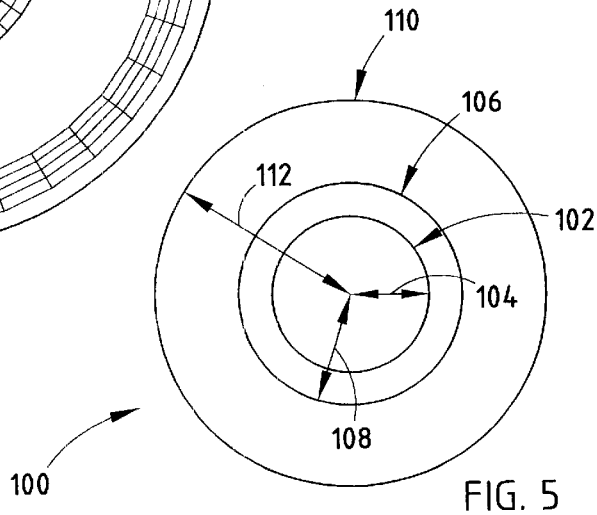
FIG. 5 is a cross-sectional view of a light beam coming from the reflector of the present invention.

As seen in FIG. 5, a plane 100 through the first substantially conical beam perpendicular to the line of propagation 101 at any point along the line of propagation 101 produces a first circle 102 having a first radius 104. Likewise, the plane 100 through the second substantially conical beam perpendicular to the line of propagation 101 produces a second circle 106 having a second radius 108. Moreover, the plane 100 through the third substantially conical beam perpendicular to the line of propagation 101 produces a third circle 110 having a third radius 112. The first radius 104 of the first circle 102 is smaller than the second radius 108 of the second circle 106 and the third radius 112 of the third circle 110. Furthermore, the second radius 108 of the second circle 106 is smaller than the third radius 112 of the third circle 110. As is known to those skilled in the art, the smooth surface 34 of the third portion 26 of the reflector 18 will reflect light rays from the light source 16 such that the light rays coming from the light source 16 will reflect to cover the cross-sectional area of the first substantially conical beam of light. However, the illumination from the light rays reflecting off of the first facets 30 will be superpositioned such that light coming from multiple first facets 30 will cross. Likewise, the illumination from the light rays reflecting off of the second facets 32 will be superpositioned such that light coming from multiple second facets 32 will cross. The superposition of the light rays from the first facets 30 and the second facets 32, as well as the superposition of the beams of light from the first portion 24, the second portion 28 and the third portion 26 of the reflector 18, builds robustness in the reflected light and will compensate for imperfections in, among other things, the light source and/or reflector and/or filament positioning in the light source. Using the preferred reflector 18 having the dimensions described above and the light source 16 being a C-2R filament in a miniature incandescent lamp, the first circle 102 produced by the smooth surface 34 of the third surface 26 of the reflector 18 will be approximately 50 mm in diameter at a distance of 3 feet. Likewise, the second circle 106 produced by the first facets 30 of the first region 24 of the reflector 18 will be approximately 140 mm in diameter and the third circle 110 produced by the second facets 32 of the second region 28 of the reflector 18 will be approximately 460 mm in diameter.

The preferred dimensions and orientation of each facet in the first region 24 and the second region 28 of the reflector 18 were determined from the dimensions of the desired second circle 106 and third circle 110, respectively, as described above, using a known technique called many-to-one mapping. The facets, which are flat planes substantially tangent to the surface of the reflector 18, were designed and oriented in such a way as to allow the top point of the facet, or plane, to direct a light ray to the top of a corresponding region of a respective circle of light, while the bottom point will direct a light ray to the bottom of the corresponding region of the respective circle of light. For example, the first facets 30 from the first region 24 of the reflector 18 will reflect light from a top of the second circle 106 to a bottom of the second circle 106. Likewise, the second facets 32 from the second region 28 of the reflector 18 will reflect light from a top of the third circle 110 to a bottom of the third circle 110. Moving inward on the surface of the reflector 18, the top of the next facet will once again direct a ray to the top of the corresponding region of the respective circle of light, while the bottom of this facet will direct a ray to the bottom of the corresponding region of the respective circle of light. Therefore, in each faceted region, the top of every facet should direct light rays to the top of the corresponding region of the respective circle of light, while the bottom point of every facet should direct light rays to the bottom of the corresponding region of the respective circle of light. Therefore, this technique is called many-to-one mapping.

It will be readily appreciated by those skilled in the art that modifications may be made to the invention without departing from the concepts disclosed herein. For example, the reflector described above can be used in items other than flashlights, such as in headlights or other items that produce a beam of reflected and directed light. Such modifications are to be considered as included in the following claims, unless these claims by their language expressly state otherwise.

I claim:

1. A reflector comprising:

a concave body having a first region, a second region and a third region;

the first region including first facets;

the second region including second facets;

the third region having a smooth surface;

wherein the first region is separated from the second region by the third region.

2. The reflector as set forth in claim 1, wherein:

the concave body has a closed, substantially parabolic shape.

3. The reflector as set forth in claim 2, wherein:

a central region of the body includes an opening for accepting a light source therethrough.

4. The reflector as set forth in claim 3, wherein:

the body includes an inner rim defining the opening and an outer rim defining a periphery of the body;

the first region is adjacent the inner rim; and the second region is adjacent the outer rim.

5. The reflector as set forth in claim 4, wherein:

each of the first facets and each of the second facets has a substantially trapezoidal shape;

the first facets are arranged azimuthally about a first circumferential area of the body in a first plurality of rows;

the second facets are arranged azimuthally about a second circumferential area of the body in a second plurality of rows; and the third region is arranged azimuthally about a third circumferential area of the body.

6. The reflector as set forth in claim 5, wherein:

each of the first plurality of rows has an equal number of first facets; and each of the second plurality of rows has an equal number of second facets.

7. The reflector as set forth in claim 6, wherein:

the first facets and the second facets are planar.

8. A portable lighting device comprising:

a battery housing; and a bezel connected to the battery housing, the bezel including a light source configured to be electrically connected to batteries in the battery housing, a reflector and a covering for the light source, the covering being configured to allow light rays coming from the light source and the reflector to pass therethrough;

the reflector including a concave body having a first region, a second region and a third region, the first region including first facets, the second region including second facets, and the third region having a smooth surface;

wherein the first region is separated from the second region by the third region.

9. The portable lighting device as set forth in claim 8, wherein:

the concave body has a closed, substantially parabolic shape.

10. The portable lighting device as set forth in claim 9, wherein:

a central region of the body includes an opening for accepting the light source therethrough.

11. The portable lighting device as set forth in claim 10, wherein:

the body includes an inner rim defining the opening and an outer rim defining a periphery of the body;

the first region is adjacent the inner rim; and the second region is adjacent the outer rim.

12. The portable lighting device as set forth in claim 11, wherein:

each of the first facets and the second facets has a substantially trapezoidal shape;

the first facets are arranged azimuthally about a first circumferential area of the body in a first plurality of rows;

the second facets are arranged azimuthally about a second circumferential area of the body in a second plurality of rows; and the third region is arranged azimuthally about a third circumferential area of the body.

13. The portable lighting device as set forth in claim 12, wherein:

each of the first plurality of rows has an equal number of first facets; and each of the second plurality of rows has an equal number of second facets.

14. The portable lighting device as set forth in claim 13, wherein:

each of the first facets and the second facets are planar.

15. A light reflector comprising:

a concave body including an outer rim defining a periphery of the body; and a light source located within a concave area defined by the body, the light source being configured to emit light rays;

the body having a first faceted region, a second faceted region and a smooth region;

the smooth region configured to reflect light rays coming from the light source into a first substantially conical beam of reflected light;

the first faceted region configured to reflect light rays coming from the light source into a second substantially conical beam of reflected light; and the second faceted region configured to reflect light rays coming from the light source into a third substantially conical beam of reflected light;

the first substantially conical beam of reflected light, the second substantially conical beam of reflected light and the third substantially conical beam of reflected light having a line of propagation through an axis of each of the first substantially conical beam of reflected light, the second substantially conical beam of reflected light and the third substantially conical beam of reflected light, respectively;

wherein a first radius of a first circle defined by a plane through the first substantially conical beam perpendicular to the line of propagation is smaller than a second radius of a second circle defined by the plane through the second substantially conical beam at any point along the line of propagation, and the second radius of the second circle defined by the plane through the second substantially conical beam perpendicular to the line of propagation is smaller than a third radius of a third circle defined by the plane through the third substantially conical beam at any point along the line of propagation.

16. The light reflector as set forth in claim 15, wherein:

the smooth region is located between the first faceted region and the second faceted region.

17. The light reflector as set forth in claim 16, wherein:

the concave body has a closed, substantially parabolic shape.

18. The light reflector as set forth in claim 17, wherein:

a central region of the body includes an opening for accepting the light source therethrough.

19. The light reflector as set forth in claim 18, wherein:

the body includes an inner rim defining the opening;

the first faceted region is adjacent the inner rim; and the second faceted region is adjacent the outer rim.

20. The reflector as set forth in claim 4, wherein:

the first faceted region includes first facets;

the second faceted region includes second facets;

each of the first facets and the second facets has a substantially trapezoidal shape;

the first facets are arranged azimuthally about a first circumferential area of the body in a first plurality of rows;

the second facets are arranged azimuthally about a second circumferential area of the body in a second plurality of rows; and the smooth region is arranged azimuthally about a third circumferential area of the body.

21. The light reflector as set forth in claim 20, wherein:

each of the first plurality of rows has an equal number of first facets; and each of the second plurality of rows has an equal number of second facets.

22. The light reflector as set forth in claim 21, wherein:

the first facets and the second facets are planar.

* * * * *